United States Patent [19]

Yellen

[11] Patent Number: 4,647,035

[45] Date of Patent: Mar. 3, 1987

[54] ROWING EXERCISE DEVICE

[76] Inventor: Robert Yellen, 1210 Bahama Bend A2, Coconut Creek, Fla. 33066

[21] Appl. No.: 631,255

[22] Filed: Jul. 16, 1984

[51] Int. Cl.[4] ..... A63B 69/06

[52] U.S. Cl. ..... 272/72; 272/132

[58] Field of Search ..... 272/72, 132, 138, 140, 272/127; 188/264 W, 83

[56] References Cited

U.S. PATENT DOCUMENTS

| | | | |
|---|---|---|---|
| 913,799 | 3/1909 | Zünd-Burguet | 272/140 |
| 1,139,126 | 5/1915 | Kerns | 272/140 |
| 1,734,238 | 11/1929 | Sweeney . | |
| 1,868,262 | 7/1932 | Staley . | |
| 1,983,911 | 12/1934 | Luppert | 272/72 |
| 2,761,530 | 9/1956 | Danley | 188/264 W |
| 3,051,276 | 8/1962 | Lyon | 188/264 W |
| 3,563,353 | 2/1971 | Lopresti et al. | 188/83 |
| 3,584,871 | 6/1971 | Kehnon, Jr. . | |
| 3,995,853 | 12/1975 | Deluty . | |
| 4,340,214 | 7/1982 | Schuetzer . | |

FOREIGN PATENT DOCUMENTS

| | | | |
|---|---|---|---|
| 998878 | 11/1949 | France | 272/132 |
| 2274322 | 6/1974 | France | 272/132 |
| 164288 | 12/1933 | Switzerland | 272/72 |

*Primary Examiner*—Richard J. Apley
*Assistant Examiner*—John L. Welsh
*Attorney, Agent, or Firm*—Malin, Haley & McHale

[57] ABSTRACT

A wheeled platform to be attached to the feet of an exerciser and rolled back and forth along the ground in front of the exerciser while he or she pulls on handles against resistance. The handles are attached to cords which wind around pulleys which are rotatably attached to a resistance mechanism mounted on the wheeled platform. Simultaneously pulling the handles away from the platform and pushing the wheeled platform away from the handles as in a rowing motion operates the resistance mechanism to provide a resisting force for exercise, and operates an energy dissipating device to shed the energy created by the resistance mechanism. After the handles have been pulled the desired distance from the platform the resistance is disengaged and a rewinding mechanism rewinds the cord as the wheeled platform is pulled back towards the user.

7 Claims, 12 Drawing Figures

ROWING EXERCISE DEVICE

BACKGROUND OF THE INVENTION

Rowing is one of the most efficient forms of exercise. The oarsman sits on a movable seat and has his feet secured to a footrest attached to the hull of the boat. The sliding action of the seat enables the oarsman to pull the oars through a stroke with the large muscles of the upper leg, the upper and lower back muscles, and the muscles of the arms and shoulders. After completing a stroke the oarsman lifts the oars from the water and returns to the original position by pulling himself forward on the sliding seat with the muscles of the abdomen and rear thigh. The movement of the boat is resisted by the drag force of the water on the hull.

Many devices have been designed for rowing exercise. Most of these devices consist of a stationaryfootrest attached to a frame, a sliding seat mounted on the frame, and handles to be pulled by the user against resistance to simulate the movement and resistance of the oars of a boat. Some devices employ a seat immoveably attached to a frame with a movable footrest. Portable rowing exercise devices have been designed with springs or rubber strips for resistance.

The most desirable rowing exercise devices use a resistance means which provides a fairly constant resisting force for the entire stroke, and a means of disengaging the resisting force for the return. Cylinders, fans, springs, elastic or frictional resistance devices can be used to provide the resisting force with an appropriate clutch, ratchet or valve for disengaging it (springs and elastics are self disengaging). Each kind of resistance means has drawbacks: force exerted by a spring is proportional to the spring's extension, and hence would not be constant over a stroke; friction means heat with intensive use, causing the resistive force to lessen, or "fade"; fans exert a force proportional to the volume of air moved by the fan, and thus, for intensive training, a fan too large for a portable device would be necessary; hydraulic or pneumatic cylinders, although better suited for intensive training, are unduly expensive and also too large for a portable device. Any invention that can adapt friction or fan exercisers to the requirements of high intensity training in a portable rowing exerciser would be a welcome advancement in the art.

SUMMARY OF THE INVENTION

Accordingly, it is an object of this invention to provide a rowing exercise device to simulate rowing that is simple and inexpensive.

It is a further object of this invention to provide such a device that provides a constant force during the rowing stroke.

It is a further object of this invention to provide such a device that adapts moderately sized friction and blower resistance means to provide the force necessary for high intensity training.

It is a further object of this invention to provide such a device that is attached to a user's foot, to better simulate the act of rowing.

In accordance with these and other objects that shall become apparent hereinafter, there is provided a portable rowing exercise device in which a wheeled platform is attached to the feet of a user and rolled back and forth along the ground in a rowing motion. The user pulls on handles which are attached to cords which wind around pulleys. The pulleys operate a resistance means when the platform is pushed away from the user, thus simulating the stroke of the oars on a boat. A rewind means rewinds the cord around the pulleys when the platform is pulled back towards the user. Several embodiments of the resistance and rewind means are described for constructing the rowing exercise device, including friction or fan means, which are adapted to high intensity training by rotatively coupling the friction or fan means to the axle on which the pulley rides via gears having a relatively high gear ratio so as to increase the power necessary to cycle the device at a given frequency.

The instant invention will be more fully understood from the following detailed description, it being understood, however, that the invention is capable of extended application, and is not confined to the precise disclosure. Changes and modifications may be made that do not affect the spirit of the invention, nor exceed the scope thereof, as expressed in the appended claims. Accordingly, the instant invention will now be described with reference to the accompanying drawings.

DETAILED DESCRIPTION OF THE INVENTION

Figure 1:
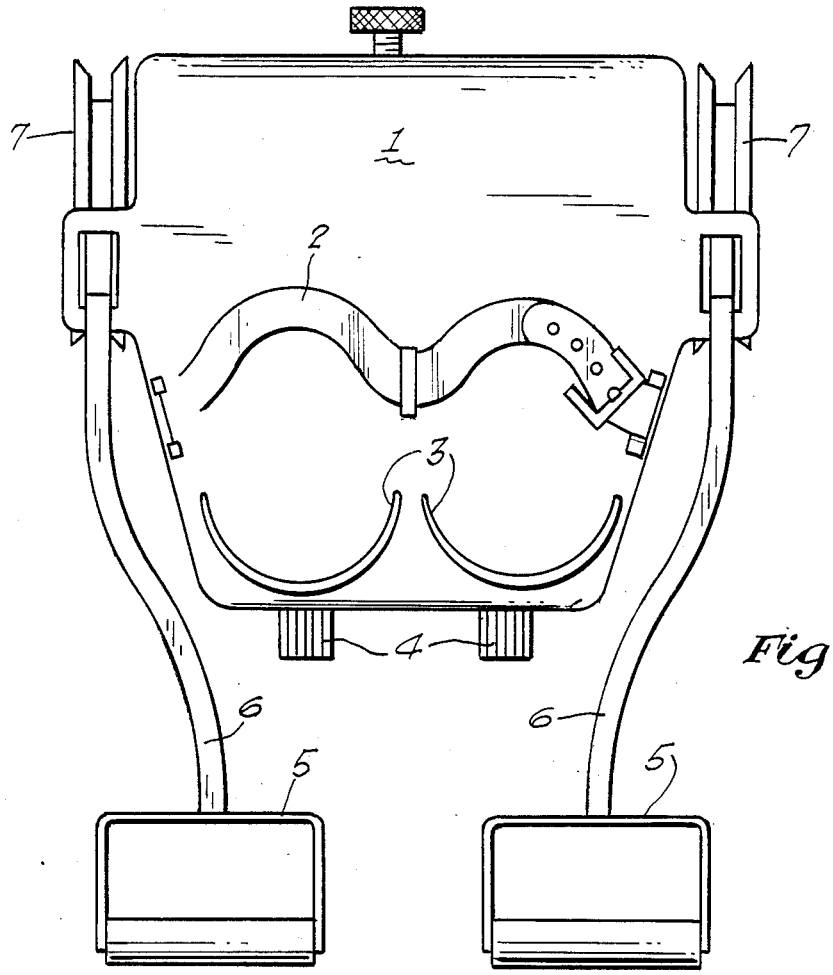
FIG. 1 is a top elevational view of the rowing exercise device of the instant invention.
Figure 2:
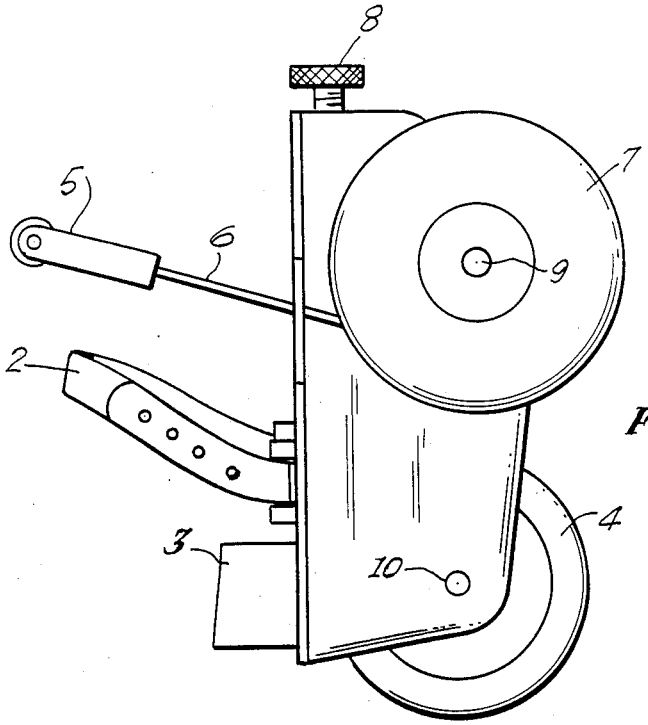
FIG. 2 is a side elevational view of the rowing exercise device.

With reference to the drawing figures, and in particular figures 1–2, there is shown the exercise device of the instant invention having a platform 1 having an upper foot engaging surface to which is fixed foot strap 2 and heel cups 3. On the underside of platform 1 opposite the foot engaging surface is a pair of wheels 4 and pulleys 7. Cords 6 having handles 5 are operatively wrapped about pulleys 7. Pulleys 7 are rotatively mounted on axle 9, and wheels 4 are rotatively mounted upon axle 10. The platform has a front 1' adjacent the toes of the user and a rear 1'' shown in FIGS. 3A and 3B.

Figure 3A:
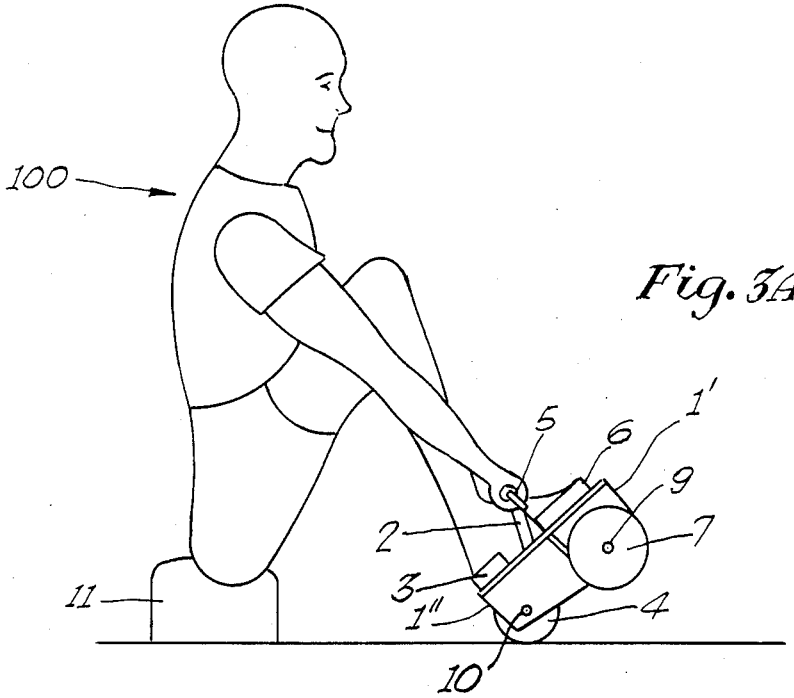
FIGS. 3A and 3B show the rowing exercise device employed by a user.
Figure 3B:
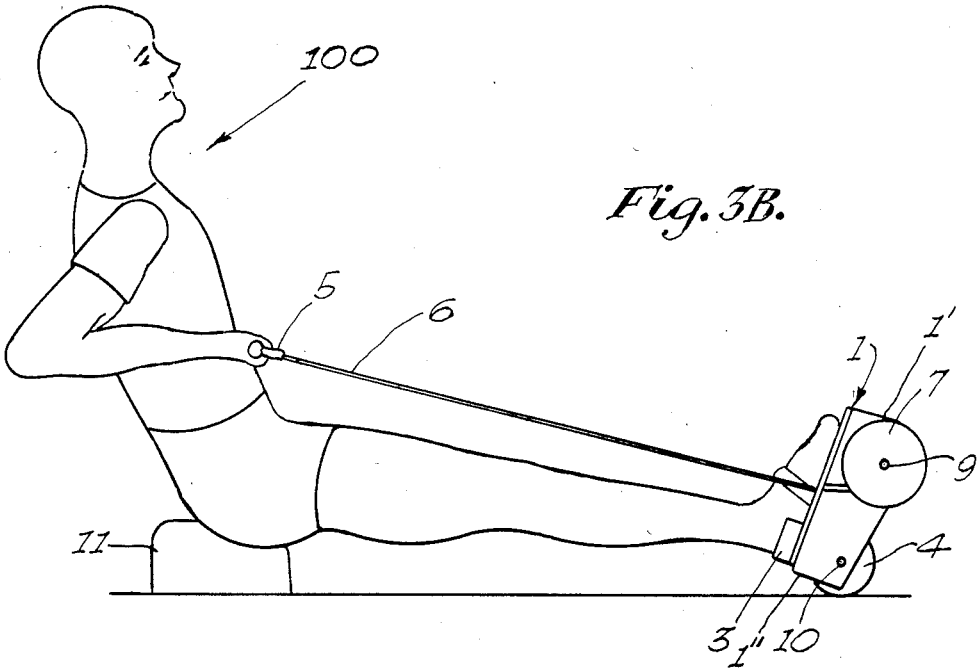

With particular reference to FIGS. 3A and 3B, the operation of the exercise device is illustrated. A user 100 of the exercise device places his or her feet on platform 1 with heels braced against heel cups 3, and attaches strap 2 across his or her feet to securely fix them on platform 1. User 100 then sits on seat 11, draws the exercise device towards him or herself and grasps handle 5, as illustrated in FIG. 3A. User 100 now extends cords 6 by pushing the device outward and pulling backwards handle 5, as shown in FIG. 3B. The exercise device rolls across the floor on wheels 4, as shown in FIG. 3B. This extension is done in opposition to resistance supplied by a plurality of means, more about which below. The user then brings the exercise device back towards himself or herself, allowing cord 6 to be rewound on pulley 7 by a rewinding means, more about which below. The user repeats this motion a sufficient number of times, and with sufficient rapidity, to complete his or her exercise routine.

Figure 4A:
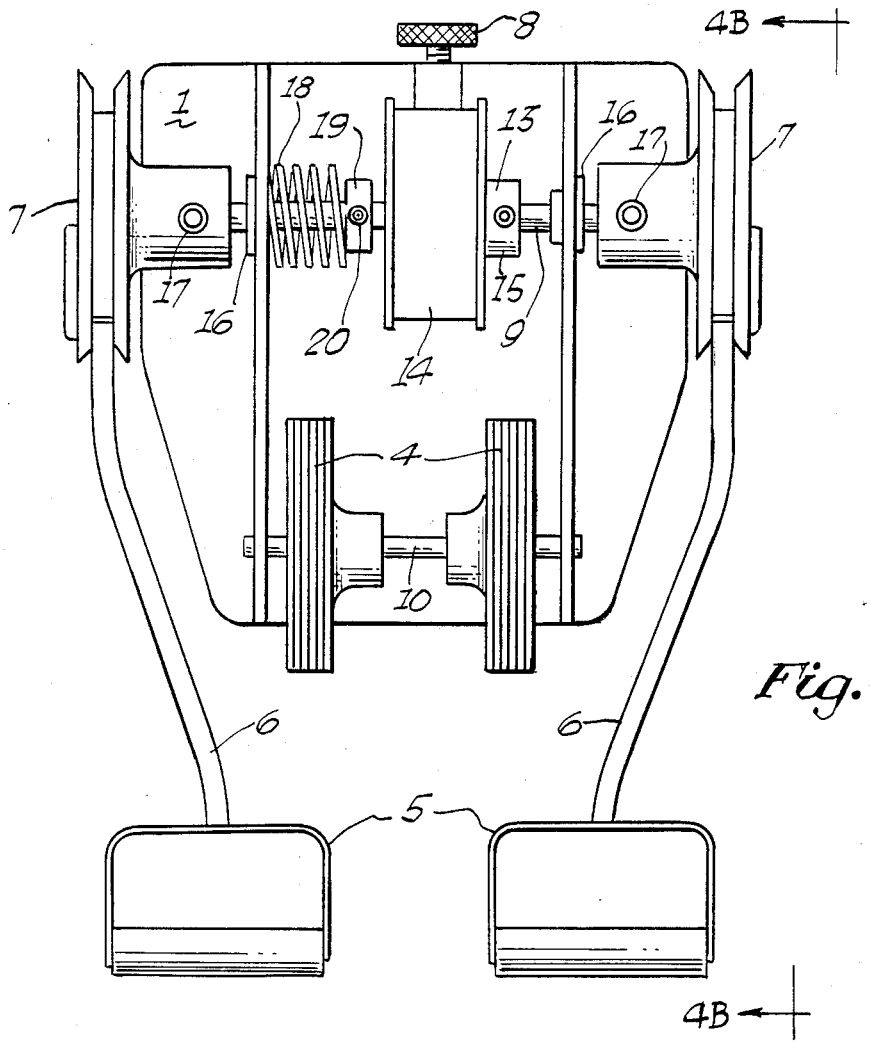
FIG. 4A is a bottom plan view of the rowing exercise device.
Figure 4B:
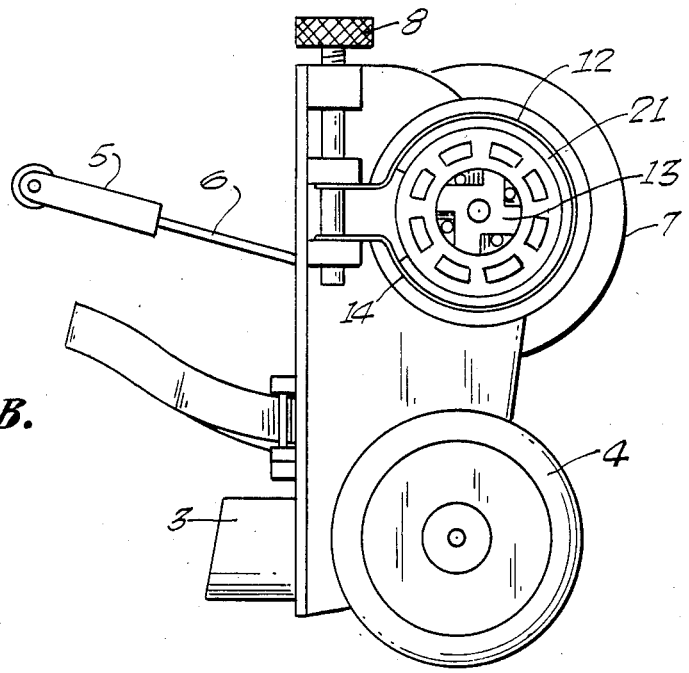
FIG. 4B is a side plan view of the device shown in FIG. 4A, taken along line 4B—4B and looking in the direction of the arrows.

With particular reference to FIGS. 4A and 4B, the internal workings of a simplified version of the exercise device is shown. Wheels 4 are mounted via axle 10 directly to platform 1, and are free to turn independently of any other mechanism in the exercise device. Pulley axle 9 has rotatively mounted upon it a brake wheel 12 and a rewinding spring 18. Brake wheel 12 in combination with brake strap 14 provides preselected resistance to user 100's pulling of cords 6 outward from pulleys 7. In particular, brake wheel 12 has a rotational brake drum, note that the drum is the rotating part of the brake 21 that rotates with axle 9. Friction between member 21 of wheel 12, and member 14, provide the preselected resistance against which user 100 pulls. This preselected resistance is adjusted via screw 8, which is threadedly received by the distally opposite ends of member 14, as illustrated in FIG. 4B. Cage assembly 13, immediately adjacent brake wheel 12, contains a means for disengaging brake wheel 12 from axle 9 when cord 6 is being rewound upon pulley 7, and engaging brake wheel 12 when cord 6 is being pulled outward from pulleys 7. Assembly 13 can contain, for example, a directional transmission or a simple ratchet. This insures that when user 100 strokes as is shown in FIG. 3B brake wheel 12 and strap 14 shall provide a constant and preselected resistance to that stroke by providing resistance to the rotation of pulley axle 9. The directionally selective cage assembly 13 insures that when cord 6 is being rewound upon pulleys 7 brake wheel 12 is disengaged and provides no resistance to this rewinding. Rewinding is accomplished by coiled spring 18 immediately adjacent bearing axle 16 and collar 19. Set screws 15, 17 and 20 serve to attach associated members to axle 9 for rotation therewith.

Figure 5A:
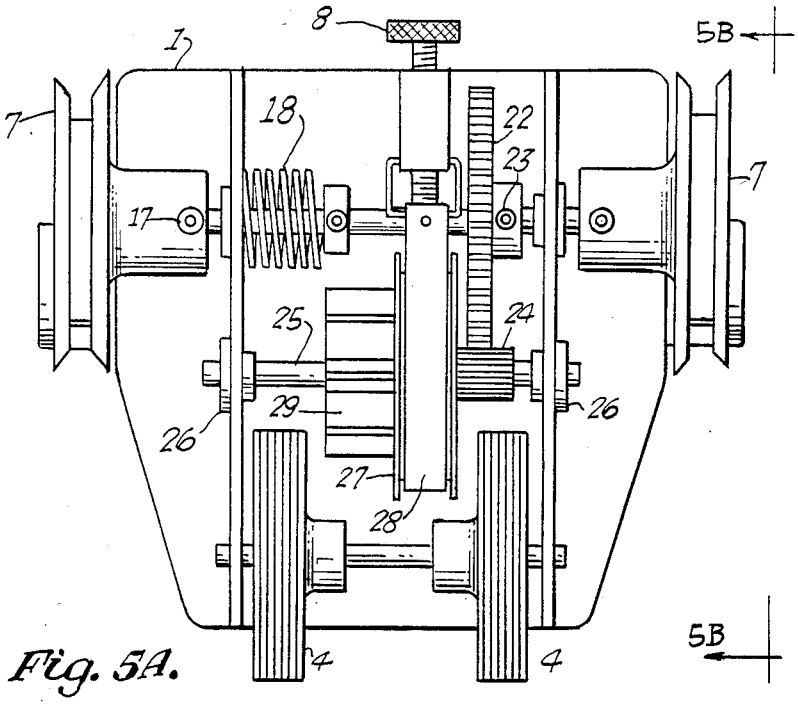
FIG. 5A is a bottom plan view of the rowing exercise device with friction brake cooling means.
Figure 5B:
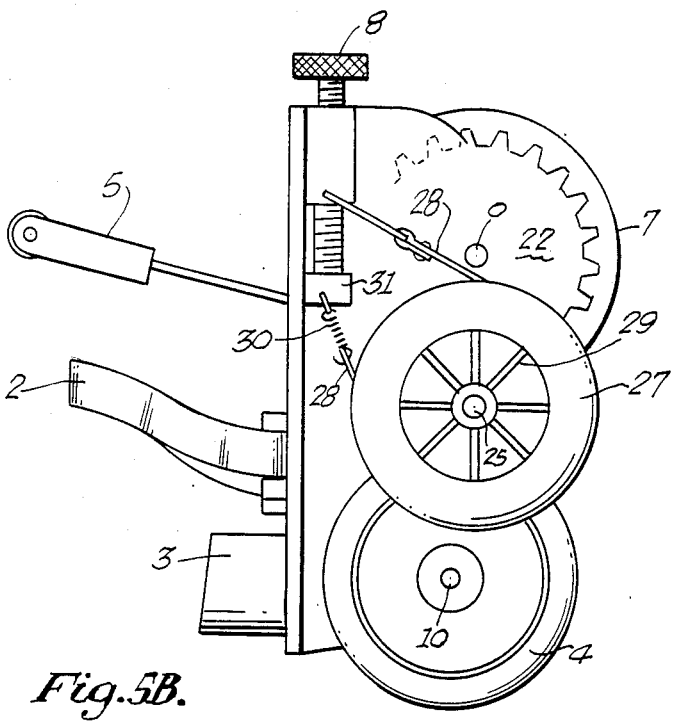
FIG. 5B is a side plan view of FIG. 5A taken along line 5B—5B and looking in the direction of the arrows.

With particular reference to FIGS. 5A and 5B, the device of FIGS. 4A and 4B is shown modified to provide for high intensity training. This modification resides in the use of gears 22, 24 to rotatively connect axle 9 and brake drum, note that the drum is the rotating part of the brake 27 and the use of cooling fins 29 attached to brake drum 27. Gears 22, 24 increase the number of revolutions brake wheel 12 must undergo per revolution of axle 9 (that is, increase the relative frequencies of brake wheel 12 to axle 9) by a factor of the gear ratio of gear 22 to gear 24. Consequently, the power exerted by user 100 per stroke is increased by a factor of the gear ratio. Obviously, sprockets and a drive chain or belt could be substituted for gears 22, 24. Once again, brake strap 28 (corresponding to member 14 of the embodiment of FIGS. 4A and 4B) is stationarily mounted to platform 1. Mounted on axle 25 and attached to brake drum 27 for rotation with gear 24, is member 29, having a plurality of cooling fins for dissipating heat generated by friction between members 27, and 28. Rotating member 29 at a greater frequency or increasing the number or surface area of the cooling fins will increase the amount of energy dissipated. An alternative means for adjusting the friction between strap 28 and brake drum, note that the drum is the rotating part of the brake 27 is sliding block 31, whose longitudinal displacement responsive to operation of screw 8 either tightens or loosens strap 28 about brake drum, note that the drum is the rotating part of the brake 27.

Figure 6A:
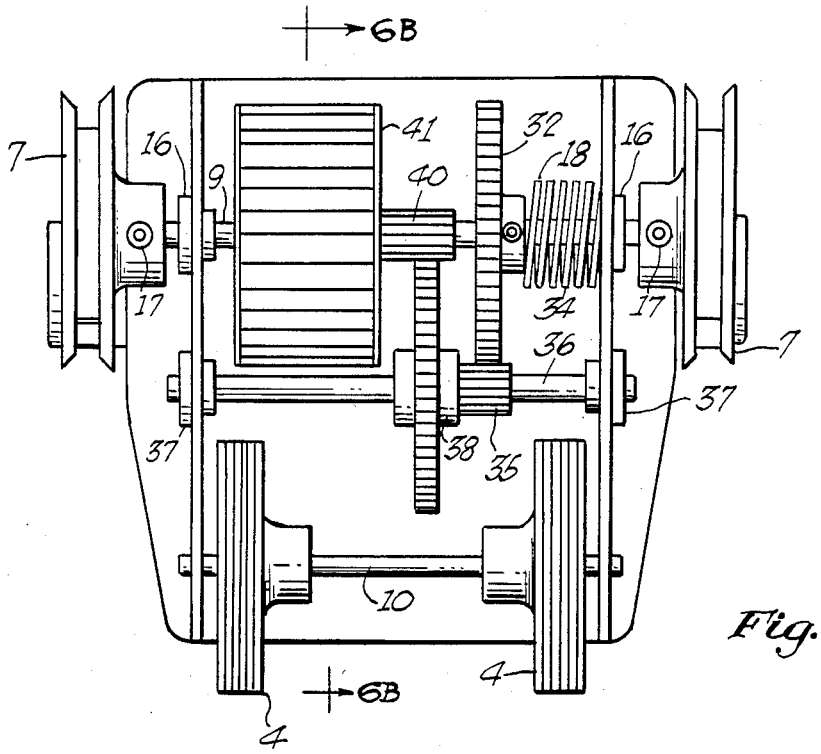
FIG. 6A is a bottom plan view of the rowing exercise device with a blower resistance means.
Figure 6B:
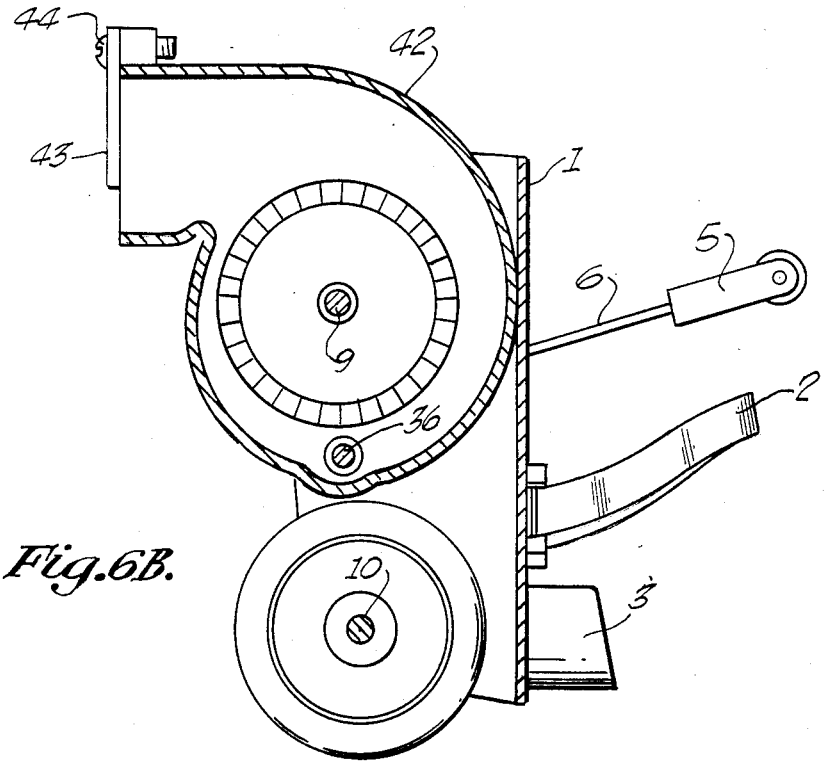
FIG. 6B is a cross-sectional side plan view of FIG. 6A taken along line 6—6 of FIG. 6A with a blower shroud shown.

With particular reference to FIGS. 6A and 6B, an alternative embodiment of the exercise device is shown employing blower wheel 41 as the resistance means. Blower wheel 41 rotates about, but not with, pulley axle 9, wheel 41 being rotated exclusively by gear 40. Gear 40 is rotationally connected ultimately to axle 9 by gears 39, 35, and 32, the latter of which rotates with axle 9 at all times. Intermediate gears 35, 39 are rotationally attached to axle 36 having bearings 37. Blower wheel 41 is caused to rotate with, or be disconnected from, axle 9 by member 38, which, as before, can be either a ratchet or a directional clutch. As can be seen by inspecting FIG. 6A, the respective gear ratios of gears 32, 35, 39, 40 insure that for a given rotational frequency of axle 9, the rotational frequency of blower wheel 41 will be considerably greater, necessitating that user 100 exert much more power while exercising. It is this gearing ratio that enables such a blower wheel to provide the selectively increased resistance necessary for intensive training. The resistance generated by blower wheel 41 can be additionally increased by using adjustable cover 43, 44 to vary the exhaust opening in blower shroud 42. Alternatively, adjustable cover 43, 44 could vary the inlet opening (not shown) in blower shroud 42.

Figure 7:
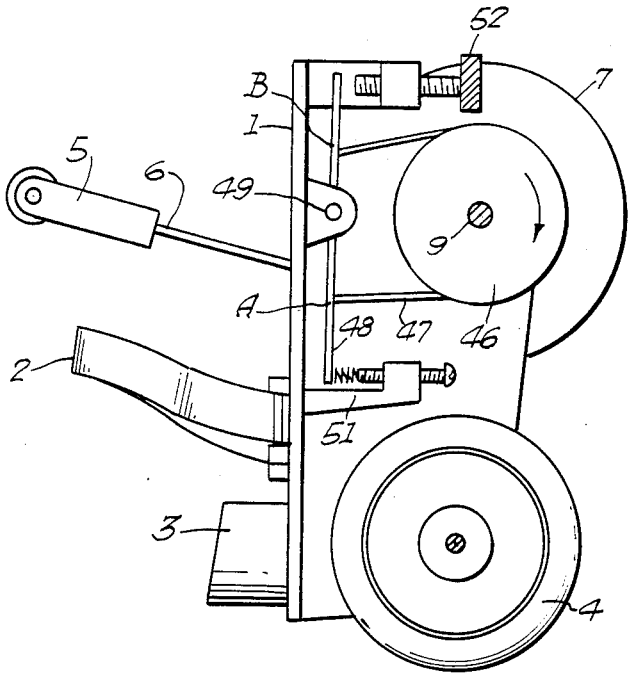
FIG. 7 is a side plan view of the rowing exercise device showing a self-energizing brake resistance means.

With particular reference to FIG. 7, an alternative, "self-energizing," form of the resistance means is shown employing brake band 47 and brake drum, note that the drum is the rotating part of the brake 46 similar to embodiments discussed above, but differing in that brake band 47 is attached to lever 48 at points A and B, lever 48 being attached to fulcrum point 49 mediate of points A and B. Note that point A is substantially closer to fulcrum point 49 that is point B. The result of this orientation of A, B, and 49 is that, when the exercise device is pulled towards user 100, lever 48 operates to tighten brake band 47 about brake drum, note that the drum is the rotating part of the brake 46, resulting in high resistance to pull, but when exercise device is moved away from user 100 lever 48 causes band 47 to hang loosely about brake shoe 46 resulting in virtually no resistance. Screw 52 limits rotation of lever 48 in one direction, thus placing a limit on the degree to which band 47 can be tightened about brake drum, note that the drum is the rotating part of the brake 46. Tensioning screw 50 and spring 51 can fine tune the tightness of band 47 about brake drum, note that the drum is the rotating part of the brake 46.

Figure 8:
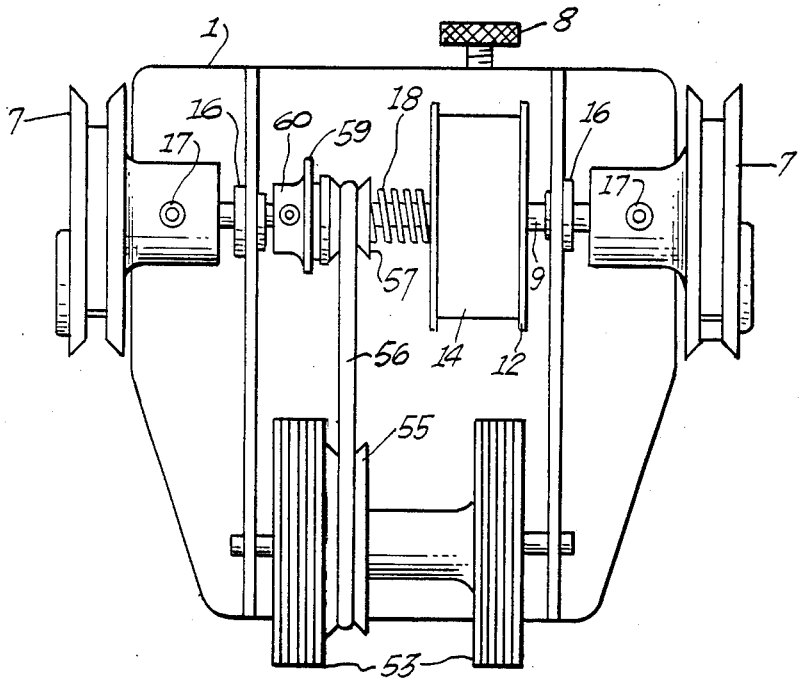
FIG. 8 is a bottom plan view of the rowing exercise device showing a belt-drive rewind means.

With particular reference to FIG. 8, a final embodiment of the exercise device is shown, in which brake 12, 14 is rotationally connected to wheels 53 by pulley and belt 55, 56, 57. Brake 12, 14 functions as in the above described embodiments; however, by connecting wheels 53 and brake 12, 14, user 100 works much more intensively the leg and abdominal areas. In this embodiment, a directional transmission for the rewind means is in the form of a clutch plate 60 rotationally attached to axle 9 and coupled to wheels 53 via friction material 59 on pulley 57. As can be seen from FIG. 8, wheels 53 help rewind cord 6 about pulley 7 via belt 56, and the spring and clutch shown in FIG. 8 could be dispensed with entirely, if desired.

The foregoing sets forth what are considered to be the most practical and preferred embodiments of the invention. This has been done for purposes of illustration, rather than limitation, and it is understood that obvious modifications will occur to those skilled in this art, including using parts of one of the above described in combination with those of another (e.g. the frictive clutch plate of FIG. 8 in lieu of the directional clutches or ratchets of the preceding embodiments). Accordingly, the scope of the instant invention is to be discerned solely from the appended claims, wherein:

What is claimed is:

1. A portable rowing exercise device for high intensity training comprising:

a platform having a top with a foot engaging surface and a bottom opposite said top, a front portion and a rear portion;

a pulley means rotatably mounted on each side of said platform, said pulley means rotatable in an unwind direction and in a rewind direction;

a cord means connected to and wrapped around each said pulley means, said cord means for allowing rotation of each said pulley means when each said cord is pulled away from and unwound from said pulley means;

a handle attached to each said cord means;

said cord means and said pulley having a length and allowable rotation respectively for a rowing stroke between a first position of the user with said handle at the user's feet on said foot engaging surface and the user's knees drawn up to the user's chest and a second position with said handle at the user's chest and the user's legs in an extended position;

manually adjustable resistance means mounted upon said platform and connected to each said pulley, said manually adjustable resistance means for resisting the rotation of each said pulley means in an unwind direction, each said pulley means generally free of rotational resistance from said resistance means when rotating in a rewind direction;

said resistance means for also dissipating the energy created by said resistance means when resisting the rotation of each said pulley means in the unwind direction;

attachment means for securing the feet of the user to said foot engaging surface and for positioning the feet of the user on said platform so that each said cord means will be in line with the approximate middle of the feet of said user when each cord means is pulled away from and unwound from each said pulley means to said second position and when each said cord means is rewound onto each said pulley means to said first position;

rolling means connected to said bottom of said platform near said rear portion, said rolling means including at least one wheel means rotatably mounted upon said bottom of said platform, said rolling means for rolling the platform along the ground by a user with said platform connected to the user's feet, each said wheel means positioned to balance the weight of said device and the fraction of the weight of the user bearing on said platform when said platform is rolled along the ground by said user, and for rotation of said platform back and forth from said first position and said second position with said top orientated approximately perpendicular to each said cord means when said platform is rolled along the ground by the user and each said cord means is pulled away from and unwound from and rewound into each said pulley and so that the foot of the user and said foot engaging surface may maintain a nearly perpendicular position in relation to said lower legs of the user; and said platform, attachment means, and rolling means comprising means for pivoting said platform from a horizontal orientation in said first position to a vertical orientation in said second position when said rowing exercise device is in the fully extended position with reference to said user;

rewind means connected to said pulley means, said rewind means for urging each said pulley in the rewind direction when said platform is rolled toward the user.

2. The device of claim 1 wherein:

said resistance means includes a friction brake with a brake drum and a disengaging means for diensgaging said brake in said rewind direction, and an energy dissipating means including a plurality of cooling fins connected to said brake drum of said friction brake, said energy dissipating means for exhausting heat to the atmosphere

3. The device of claim 1 wherein said resistance means includes a self-energizing friction brake with a brake drum and a disengaging means for disengaging said brake in said rewind direction, and an energy dissipating means including a plurality of cooling fins connected to said brake drum of said friction brake, said energy dissipating means for exhausting heat to the atmosphere.

4. The device of claim 1 wherein said resistance means including an energy dissipating means including a blower and shroud and a disengaging means for disengaging said blower in said rewind direction.

5. The device of claim 1 wherein said rewind means comprises a resilient element.

6. The device of claim 1 wherein said rewind means comprises a mechanical link between said wheel or wheels and said pulleys wherein the rotation of said wheels causes the rotation of said pulleys.

7. The device of claim 1 wherein said rewind means includes a clutch means.

* * * * *